United States Patent [19]

Hodgetts et al.

[11] Patent Number: 4,870,238

[45] Date of Patent: Sep. 26, 1989

[54] MICROWAVE OVEN POPCORN CONTROL

[76] Inventors: Michael J. Hodgetts, 7991 Elm Leaf Dr., Germantown, Tenn. 38138; Charles W. McDonald, 4135 Cottonwood, Memphis, Tenn. 38118

[21] Appl. No.: 181,642

[22] Filed: Apr. 14, 1988

Related U.S. Application Data

[63] Continuation-in-part of Ser. No. 113,646, Oct. 26, 1987.

[51] Int. Cl.[4] ..... H05B 6/68

[52] U.S. Cl. ..... 219/10.55 M; 219/10.55 B; 219/10.55 E; 219/506; 99/323.7; 340/386; 340/451; 426/241

[58] Field of Search ..... 219/10.55 B, 10.55 R, 219/10.55 E, 10.55 M, 10.55 D, 506, 509, 497; 340/384 R, 385; 99/323.7, 323.5, 325, 327, 328, 451, DIG. 14, 493; 426/234, 241, 243, 107, 113

[56] References Cited

U.S. PATENT DOCUMENTS 3,931,757 1/1976 Goode ..... 99/323.11

4,381,439 4/1983 Miyazawa et al. ..... 219/10.55 B 4,602,147 7/1986 Gell ..... 219/509

*Primary Examiner*—Philip H. Leung

*Attorney, Agent, or Firm*—Senniger, Powers, Leavitt and Roedel

[57] ABSTRACT

A closed-loop control for sensing the completion of popcorn popping in a microwave oven and automatically shutting down the oven. A sensor is acoustically coupled to the microwave oven cavity and provides an electrical signal to an amplifier and filter. The amplified and filtered signal is processed by a pop detector which includes an integrator and shut-down command generator responsive to a decreasing rate of popping to shut the oven off. The integrator provides a pre-pop timer function to maintain the oven on until popping commences. In an alternative embodiment, the peak rate of popping is detected and held and the oven is shut off when the popping rate falls to a predetermined ratio of the peak rate or a predetermined time elapses after the peak rate is detected, whichever first occurs.

27 Claims, 13 Drawing Sheets

| | |
|---|---|
| FIG. 13 | FIG. 16 |
| FIG. 14 | FIG. 15 |

MICROWAVE OVEN POPCORN CONTROL

CROSS-REFERENCE TO RELATED APPLICATIONS

This is a continuation-in-part of U.S. patent application Ser. No. 113,646 filed Oct. 26, 1987 pending.

BACKGROUND OF THE INVENTION

In the past, popcorn has been popped in microwave ovens with somewhat limited success. One approach has been to apply microwaves for a fixed period of time. This approach typically resulted in a substantially large number of unpopped kernels if too short or in scorching of the popped popcorn if the fixed time period was too long for the specific batch of popcorn placed in the oven. Because of the batch to batch variability, a fixed period of time that is optimum for one batch may over or under-cook another batch of the "same" type of popcorn.

Another approach has been to instruct a microwave oven user (for example on instructions on the container of popcorn specifically packaged for microwave popping) to listen to the popcorn popping and shut the oven off when popping slows down. For example, one instruction says to stop microwave when rapid popping slows to two to three seconds between pops. That same instruction says that the time will range from two to five minutes. This approach requires that the microwave oven user be present during the entire popping cycle and further that the user focus close attention to the popping. This method also suffers from variability in that the user is unlikely to precisely time the two to three second interval resulting in user-to-user variability and even batch-to-batch variability with the same user, at least until that user has acquired the experience to know when to stop the oven.

SUMMARY OF THE INVENTION

The present invention overcomes the disadvantages of the prior approaches to popping popcorn in a microwave oven by providing an automatic closed-loop control which senses the peak popping rate for the popping cycle. The control monitors and time averages the popping, and shuts the oven off to avoid scorching the popped corn when the rate of popping slows down to a predetermined ratio of the peak popping rate sensed for normal loads of popcorn. For slow-to-cook loads of popcorn, the control shuts off the oven when a predetermined time elapses after the peak popping rate is sensed, again to avoid scorching.

DETAILED DESCRIPTION

Figure 1:
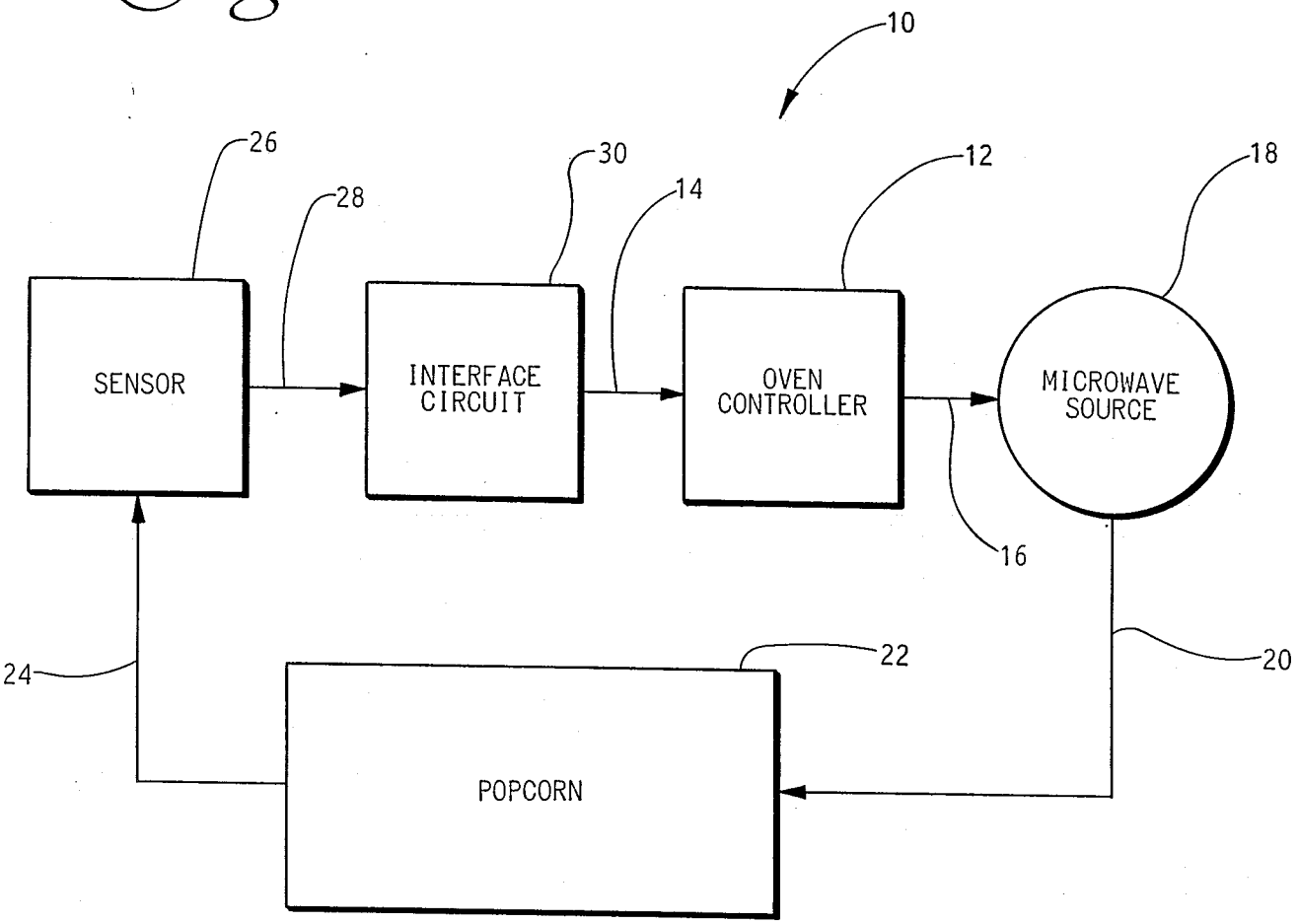
FIG. 1 shows the closed-loop block diagram of the present invention in combination with elements of a microwave oven and popcorn load.

Referring now to FIG. 1, a closed-loop control 10 for sensing the completion of popcorn popping in a microwave oven is shown in block diagram form. The control loop includes an oven controller 12 which may be either electro-mechanical or electronic, provided that it is responsive to a shut off command at input 14. Controller 12 has an output 16 to control a microwave source 18, such as a magnetron. When magnetron 18 is commanded "on" by the signal on line 16, microwave energy, indicated by arrow 20, is applied to a popcorn load 22 located in the microwave oven cavity (not shown). As popcorn 22 receives microwave energy 20, it commences popping, emitting acoustic energy 24 in the form of "pops" or impulses of sound. Energy 24 is coupled to an acoustic sensor or sound transducer 26 which provides an electrical output 28 representative of the energy 24. An interface circuit 30 has an input which receives the signal on line 28 and processes it so as to automatically provide a shut-off signal on line 14 when popcorn 22 is done popping, indicated by an end rate corresponding to the effective completion of popping. Because not every kernel in a batch can be popped without scorching the kernels already popped, the shut-off signal is made responsive to a decreasing level of popping of popcorn in the oven.

Figure 2:
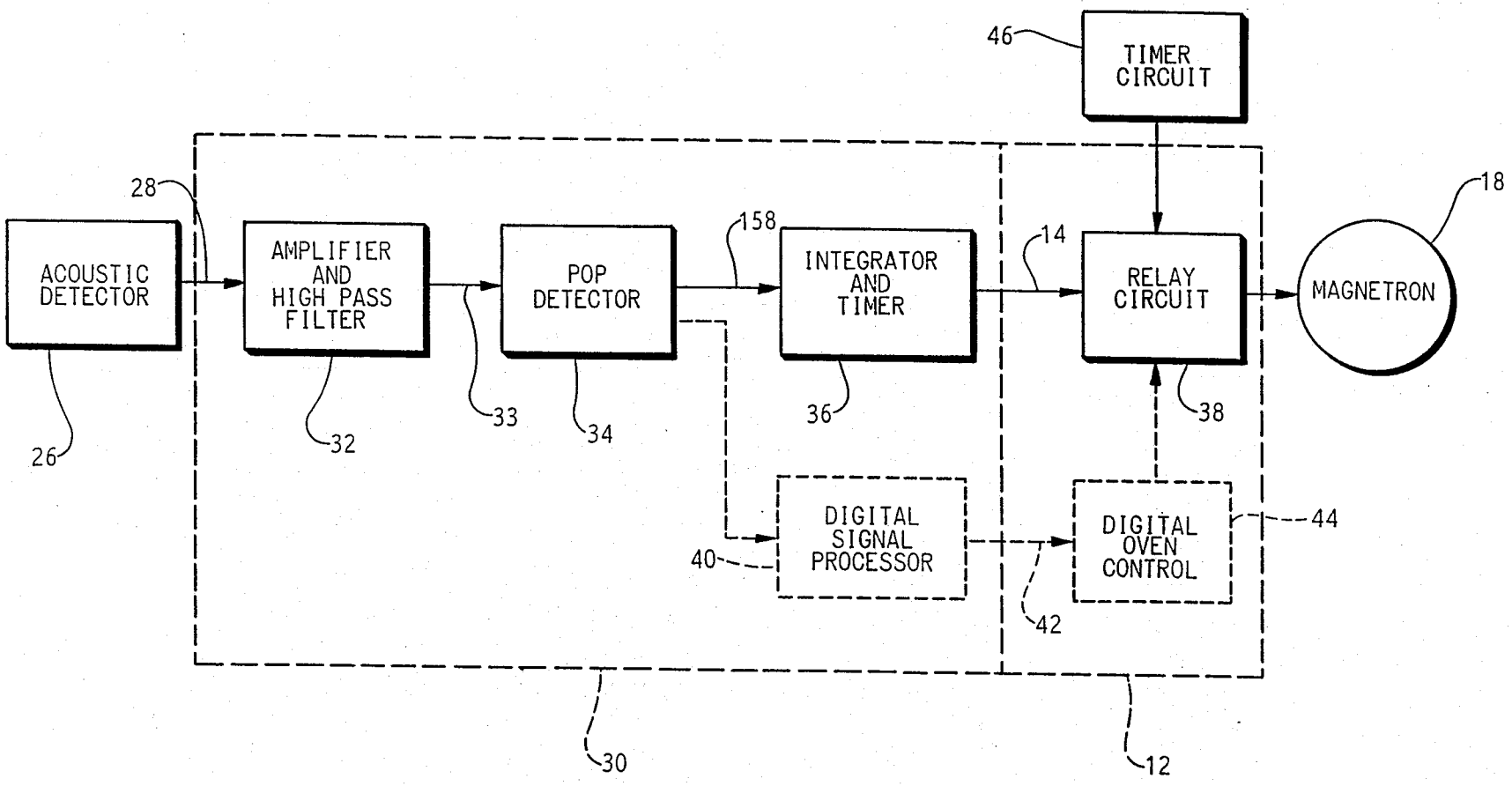
FIG. 2 shows a more detailed block diagram of an electronic control embodiment of the present invention including an alternative flow path for digital oven controls.

Referring now more particularly to FIG. 2, a portion of the control loop of FIG. 1 is shown in a more detailed block diagram. Specifically, interface circuit 30 may include an amplifier and high-pass filter block 32, a pop detector block 34, and an integrator and timer block 36. Oven controller 12 may be an electro-mechanical type, or may be a digital electronic control. If the microwave source 18 is a magnetron, controller 12 will ordinarily include a relay circuit 38 to interrupt high voltage to the magnetron. As an alternative to integrator and timer block 36, a digital signal processor 40 may be utilized to provide an appropriate command signal on line 42 to a microprocessor in a digital oven control 44. An additional timer circuit 46 may be utilized to shut off the microwave oven after a period of time set longer than the popcorn popping cycle to protect against extended oven operation in the event the oven is started without a batch of popcorn in the cavity.

Figure 3:
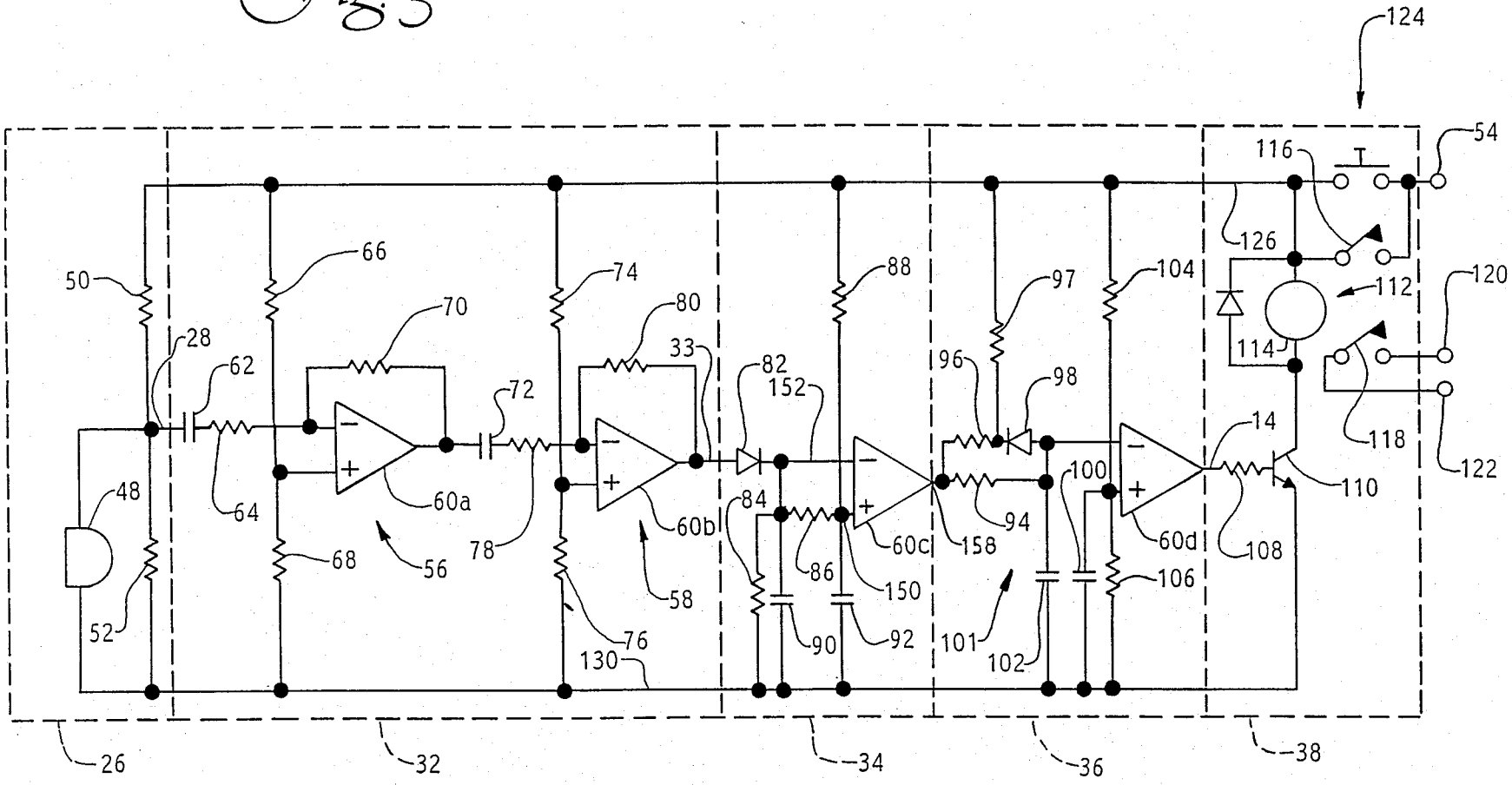
FIG. 3 shows a detailed schematic of the embodiment of FIG. 2 of the present invention.

Referring now more particularly to FIG. 3, a detailed schematic of portions of the embodiment of FIG. 2 may be seen. In this embodiment, acoustic detector 26 includes an electret microphone 48 which may be a Panasonic part number WM-034AY. Microphone 48 is biased by resistor 50, preferably 3K (ohms) and resistor 52, preferably 1.5K. It is to be understood that in this embodiment, power is preferably supplied at +15 volts DC through terminal 54.

Amplifier and filter block 32 preferably includes two amplifier stages 56, 58 each in the form of a first-order high pass filter. A type LM324 quad operational amplifier integrated circuit having four high gain amplifiers 60*a–d*, available from National Semiconductor, has been found suitable for use in this application. Stage 56 includes a 0.01 uf capacitor 62, a 100K resistor 64, two 2 MEG (ohm) resistors 66, 68, a 1 MEG resistor 70 and amplifier 60*a*. Capacitor 62 and resistor 64 form a combined impedance which provides for a first order high pass filter characteristic. The gain of stage 56 is set by the ratio of the resistance of resistor 70 to the input impedance formed by the series combination of capacitor 62 and resistor 64. Amplifier 60*a* is biased for Class A operation by resistors 66, 68.

Stage 58 includes a 0.01 uf capacitor 72, two 2 MEG resistors 74, 76, a 100K resistor 78, a 1 MEG resistor 80, and amplifier 60*b*. The elements of stage 58 perform in a similar fashion to those of stage 56.

Pop detector 34 preferably includes a conventional diode 82, such as a 1N914, a 1 MEG resistor 84, a 1.8 MEG resistor 86, a 10 MEG resistor 88, a 0.22 uf capacitor 90, a 0.1 uf capacitor 92 and amplifier 60*c* connected as a comparator. As will be explained in more detail below, capacitors 90 and 92 provide a "floating reference" network for comparator 60*c* in order to enable comparator 60*c* to discriminate popcorn popping impulses from any remaining background noise in the signal on line 33 which may be caused by the cooling fan and other components. Resistors 84, 86 and 88 provide a biasing and discharge network at the input to comparator 60*c*.

The integrator and timer block 36 preferably includes a 910K resistor 94, a 33K resistor 96, a 39K resistor 97, a 1N914 diode 98, a 0.1 uf capacitor 100, a 150 uf capacitor 102, a 1 MEG resistor 104, a 1.2 MEG resistor 106, and amplifier 60*d* connected as a comparator. Capacitor 102 and resistor 94 form a relatively long time constant RC type integrator which integrates up in a first direction when output 158 of comparator 60*c* is high. Resistors 104, 106 set a trip point for comparator 60*d* at a voltage approximately equal to the voltage which would appear across capacitor 102 after one time constant of the combination of capacitor 102 and resistor 94. After some integration in the first direction, resistors 96 and 97 and diode 98 provide a rapid discharge path for capacitor 102 when output 158 is low. The asymptotic value for the discharge, which may be thought of as integrating in a second direction, is set by a voltage divider formed by resisters 96, 97.

Relay circuit 38 preferably includes a 3K resistor 108, a conventional NPN switching transistor 110, and a relay 112 with a coil 114, a normally-open low voltage contact 116, and a normally-open high voltage contact 118. It is to be understood that contact 118 is connected in the high voltage supply to the magnetron via terminals 120, 122. A normally-open, momentary action switch 124 is connected between the +15 V DC supply 54 and the +V bus 126. It is to be understood that the oven will be "on" whenever relay 112 is energized, and that relay 112 is initially energized, along with the remainder of the elements shown in FIG. 3 upon closure of switch 124.

The operation of control 10 in a popcorn popping cycle is as follows: Power is supplied to bus 126 when switch 124 is closed and is maintained through contact 116 when switch 124 is released. Initially, even though microwave energy is applied for an initial time period, which may be fixed, there is no popcorn popping, and no pulses are detected by pop detector 34. Output 158 remains high, as does output 14 of comparator 60*d*, holding transistor 110 on, thus energizing relay 112. Sound transducer microphone 48 monitors the audible popping once it commences and provides an electrical signal on line 28, which is amplified and filtered by stages 56, 58 thus removing background noise from the signal representing the sound of popcorn popping in the microwave oven.

Capacitor 90 in pop detector 34 charges rapidly upon the occurrence of an impulse generated upon an instance of a kernel of corn popping in the oven. Capacitor 90 and 92 will "track" low frequency noise which may appear at the input to diode 82. Resistor 84 provides a discharge path for capacitor 90 to circuit common 130. The combination of resistors 84, 86 and 88 provide a voltage divider bias network for comparator 60*c* to provide a minimum threshold for a pop impulse, to avoid false switching of comparator 60*c*.

Circuit 36 includes a combined RC-type integrator and timer, followed by comparator 60*d*. In the absence of popping, the output of comparator 60*c* is held at a fixed level, close to the voltage on bus 126. When the output of comparator of 60*c* is at this level, capacitor 102 charges up in a first direction through resistor 94. While output 158 remains high, capacitor 102 charges at a rate set by resistor 94. When the voltage on capacitor on 102 exceeds the voltage at the plus summing junction of comparator 60*d*, the output 14 of comparator 60*d* switches low, shutting off transistor 110 and de-energizing relay 112. Ordinarily however, popping will occur before the voltage on capacitor 102 rises sufficiently to switch comparator 60*d*. When popping occurs, the output of comparator 60*c* is momentarily driven low, discharging capacitor 102. This delays switching of comparator 60*d* until popping slows to an end rate corresponding to the effective completion of popping. Once popping slows to this rate the output of comparator 60*d* will switch low, turning off transistor 110 and relay 112 by removing current from coil 114, thus opening contacts 116 and 118 and shutting off the oven. It is to be understood that the microwave oven controller 12 is deactivated when the time rate of popping of individual kernels of popcorn falls below a predetermined value.

Figure 4:
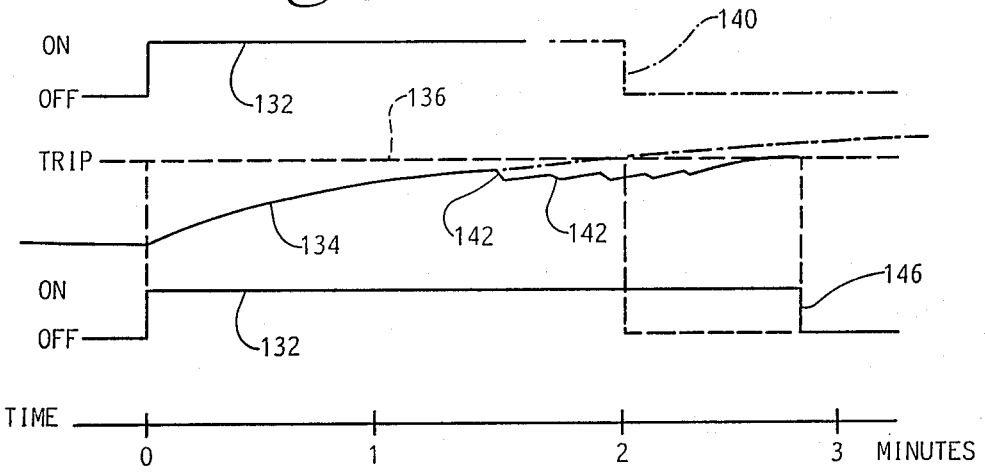
FIG. 4 shows waveforms corresponding to and illustrating the operation of FIG. 3.
Figure 5:
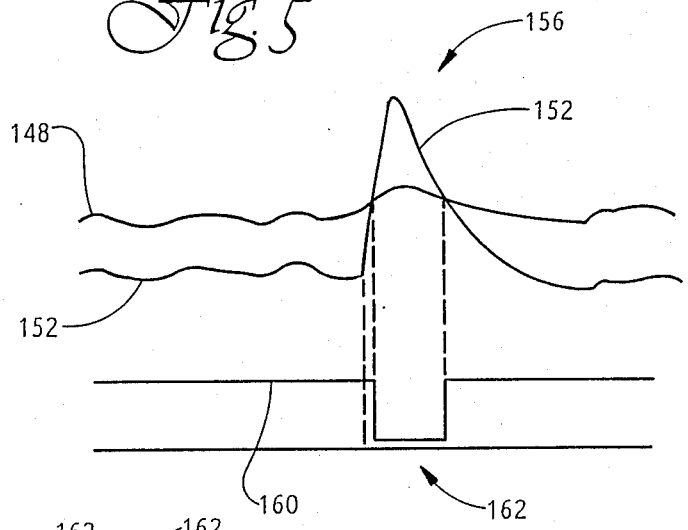
FIG. 5 shows an expanded view of the operation of the pop detector of FIGS. 2 and 3.
Figure 6:
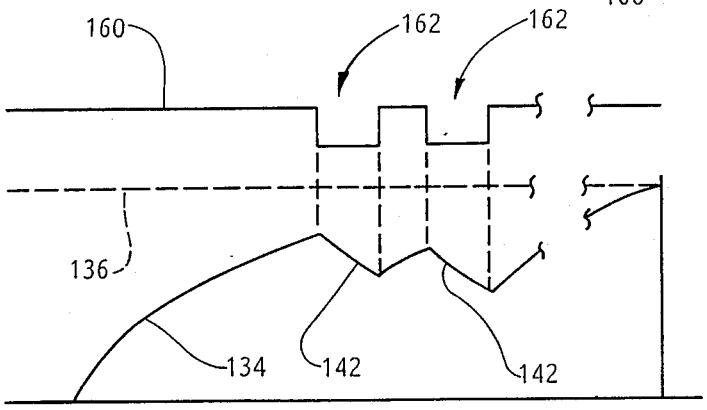
FIG. 6 shows an expanded view of a portion of FIG. 4 in connection with a waveform corresponding to FIG. 5.

Referring now also to FIGS. 4, 5 and 6 in addition to FIGS. 2 and 3, a pre-pop timer function is incorporated in block 36. This function, illustrated by waveform 132 is combined with the RC integrator 101 in block 36. Capacitor 102 of the RC integrator 101 begins to charge up as shown in waveform 134. While capacitor 102 is charging along exponential voltage rise 134, relay 112 is "on" as shown by waveform 132. In the absence of popping, waveform 134 will continue charging until trip point 136 of comparator **60*d* is reached, at which time relay 112 will switch "off" as shown at transition 140. If, however, popping commences before the timer of block 36 reaches transition 140, the integrator of block 36 will be partially reset by the action of comparator 60*c* acting through resistors 94, 96, 97 and diode 98, extending the time for the integrator 101 to reach the predetermined level 136. This partial resetting is indicated by segments 142 in waveform 134. It is to be understood that integration in the first direction is at a rate substantially slower than the rate of integration in the second direction. Waveform 134 is thus held below trip level 136 until popping slows down indicating the end of the popping cycle. Because the integrator in block 36 is partially reset, the relay 112 will not switch off at transition 140, but, instead, will switch off at transition 146 when the output 114 of comparator 60*d* switches from high to low. This partial resetting of the integrator of block 36 performs a time averaging function on the intervals between popping since the integrator capacitor 102** integrates down during each pop impulse and up in the intervals between pop impulses.

Referring now also to FIG. 5, the operation of pop detector 34 is illustrated. It is to be understood that because of capacitors 90 and 92 and resistor 86, the voltages at the positive and negative summing junctions of comparator **60*c* will track each other with an offset for a slowly changing signal at the output of block 32. This is illustrated by waveforms 148, 152 corresponding to the voltages at the positive and negative summing junctions 150, 154 respectively of comparator 60*c* When a pop is sensed by detector 26 and amplified by block 32, an impulse 156 will occur at the negative summing junction 154 of comparator 60*c*. When the voltage of waveform 152 exceeds that of waveform 148, the output 158 of pop detector 34 will transition from a high to a low state, illustrated by waveform 160. It is to be understood that the width of pulse 162 in waveform 160 is determined by both the height and the width of pop impulse 156. Each pulse 162 output from pop detector 34 causes a partial resetting or integrating down in a second direction of the integrator in block 36, as illustrated by segments 142 of waveform 134 in FIG. 6. Once popping slows down sufficiently for waveform 134 to reach trip level 136, block 36 provides a shut down or shut off command to the oven by switching comparator 60*d*** from a high to a low state output as described above.

Figure 7:
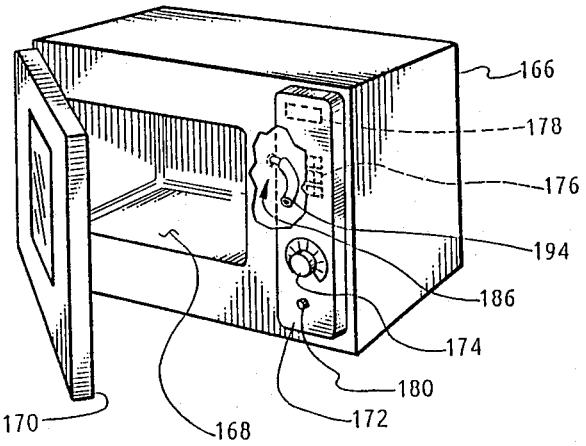
FIG. 7 is a partially cutaway view of a microwave oven illustrating certain mechanical aspects of the present invention.

Referring now to FIG. 7, a microwave oven 164 which utilizes the present invention may be seen partially cut away. Oven 164 has a housing 166 containing a cavity 168 and a door 170. Typically, oven 164 will include a control panel 172 which will have either a mechanical control input 174 such as a knob, or an electronic control input 176 such as a keyboard. Panel 172 may also have a display 178. Oven 164 preferably has a start button 180 accessible to a user of the microwave oven 164 to initiate operation of the oven by actuating switch 124.

Figure 8:
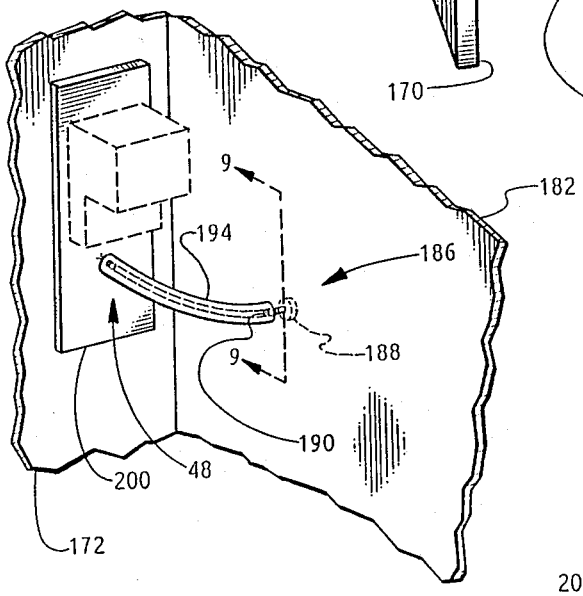
FIG. 8 is an enlarged cutaway view of a portion of the interior of the oven of FIG. 7.
Figure 9:
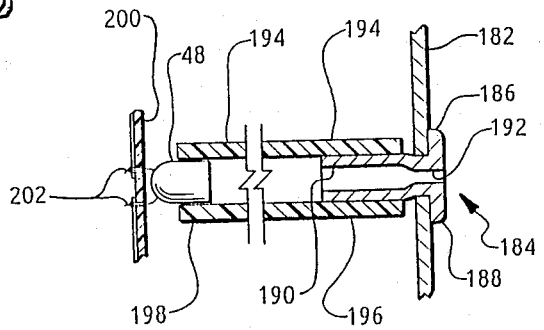
FIG. 9 is a partial section view taken along line 9—9 of FIG. 8.

Referring now also to FIGS. 8 and 9, cavity 168 has an interior wall 182 having an aperture 184 therein. Preferably, aperture 184 has a hollow rivet-like structure 186 having a flange 188 interior of the cavity and a projection 190 exterior of the cavity. Projection 190 may be swagged or enlarged to lock structure 186 to wall 182. It is to be understood that structure 186 is preferably metallic and contains a hollow internal region 192 of sufficiently small cross section to prevent the passage of microwaves therethrough thus functioning as a waveguide beyond cutoff. A first end 196 of a hollow tube or conduit 194 is received on projection 190. Tube 194 is preferably formed of flexible plastic suitable for coupling acoustic energy from aperture 184 to sensor 26. A second end 198 of tube 194 is received on microphone 48 which in one embodiment is preferably mounted to a printed circuit board 200 which may contain additional components of the microwave oven controller 12 and interface 30. Alternatively, aperture 184 may be used without structure 186, in which event aperture 184 is to be of sufficiently small cross section to prevent passage of microwaves. Tube 194 may be fastened to wall 182 in any suitable fashion, for example by adhesive, if desired.

Utilizing the structure of a hollow tube 194 or its equivalent permits convenient placement of sensor 48 while still maintaining acoustic coupling between sensor 48 and the aperture 184 in cavity wall 182. Utilizing structure 186 or an equivalent functioning as a waveguide beyond cutoff prevents microwave energy from reaching pickup or detector 48 and thus prevents microwave energy from interfering with the operation of detector 48. Alternatively, detector 48 may be located in close proximity to projection 190, with electrical leads 202 on detector 48 extending to board 200.

Figure 10:
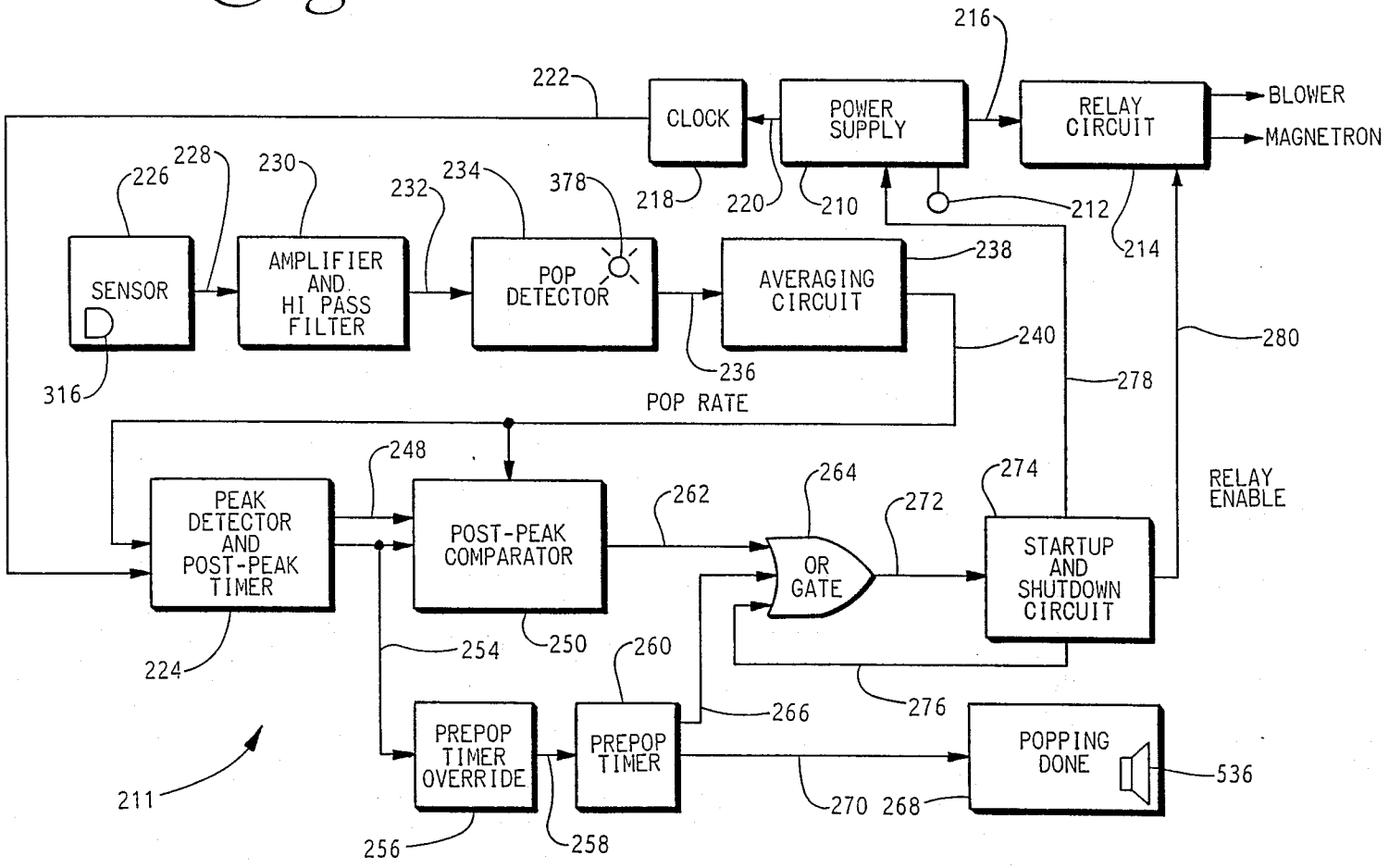
FIG. 10 is a block diagram of an alternative embodiment of the present invention.

Referring now more particularly to FIG. 10, a block diagram of an alternative embodiment or system 211 of the present invention may be seen. In this embodiment, a method of popping popcorn in a microwave oven includes applying microwave energy to the popcorn, acoustically monitoring the popcorn and providing a pop rate signal proportional to the rate of popping, sensing and retaining the highest level of the pop rate signal as a peak pop rate, and finally, terminating the application of microwave energy when the rate of popping falls to a predetermined ratio of the peak pop rate.

It is to be understood that although the embodiments disclosed provide for acoustic monitoring on a continuous basis, such monitoring may be discontinuous and may be periodic, or sampled, for example, to avoid picking up periodic noise which may be present in the oven. This embodiment includes a Power Supply 210 to supply a regulated DC voltage 212, which in this embodiment is 12 volts. Power Supply 210 also powers a Relay Circuit 214 through line 216. Line 216 is a switched, unregulated voltage of approximately 16 volts. It is to be understood that line 216 must be at least 3 volts above the regulated DC voltage 212 to allow power supply 210 to regulate voltage 212.

Figures 11, 12:
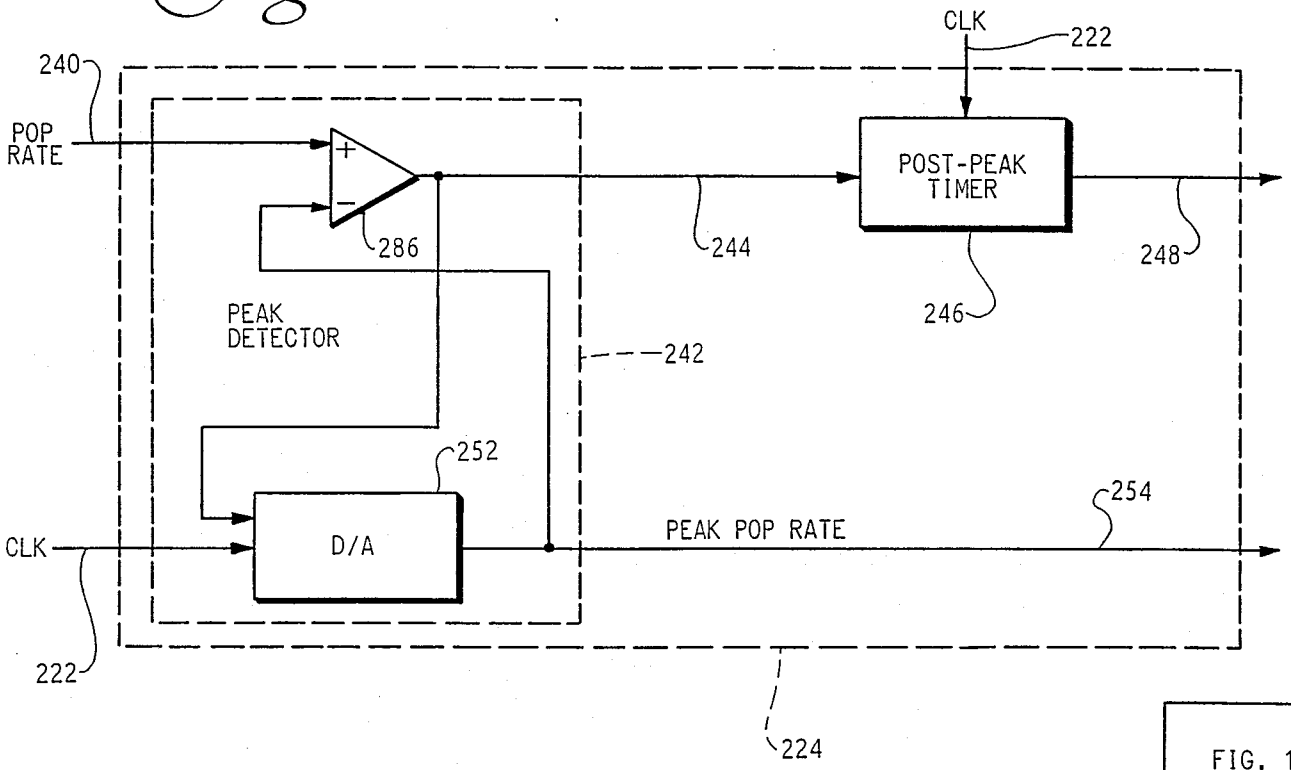
FIG. 11 is a more detailed block diagram of the peak detector and post-peak timer of FIG. 10.
FIG. 12 is a key to FIGS. 13–16.
Figure 14:
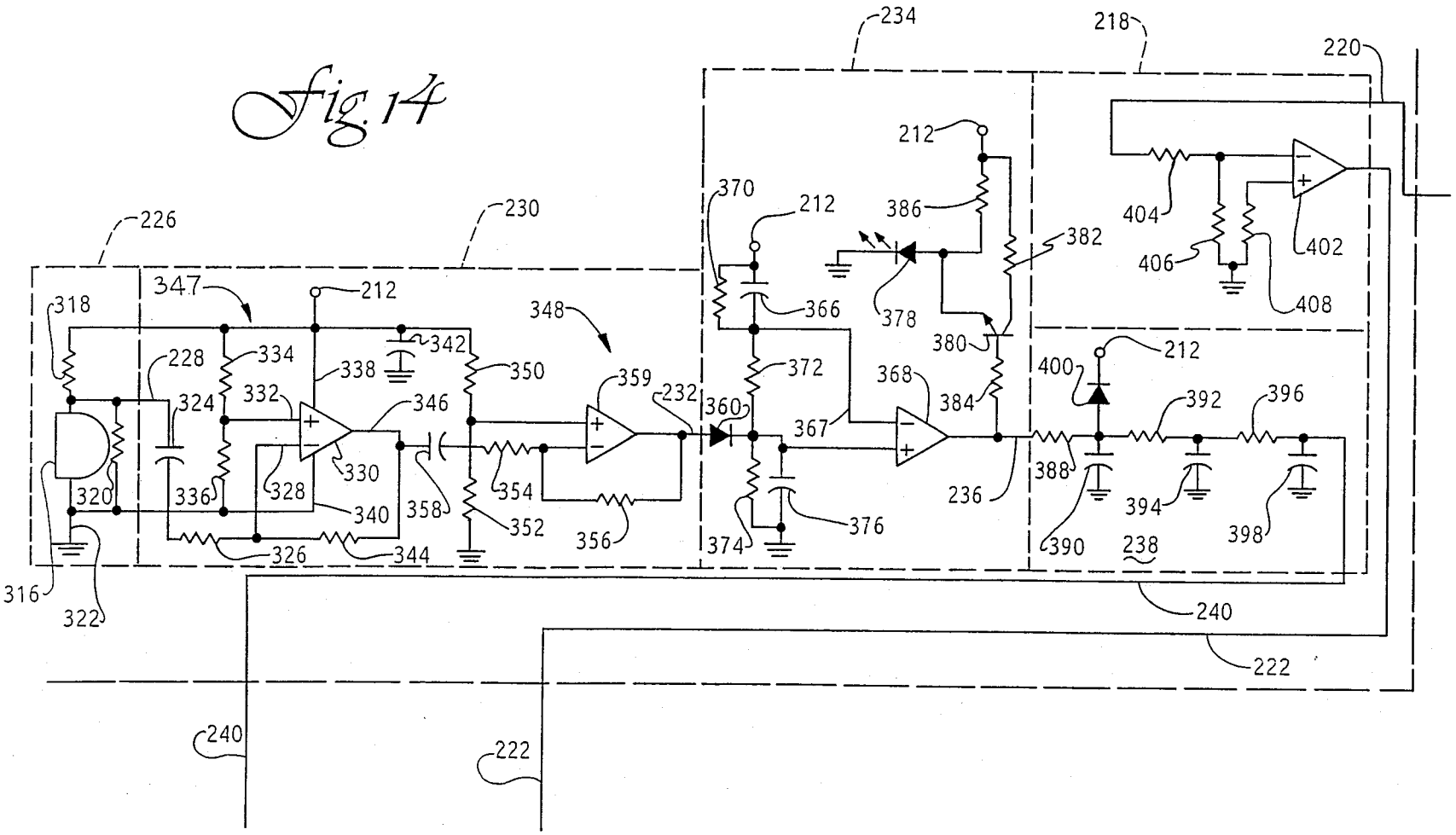
FIG. 14 is a detailed electrical schematic of the sensor, amplifier and high-pass filter, pop detector, averaging circuit, and clock of FIG. 10.
Figure 15:
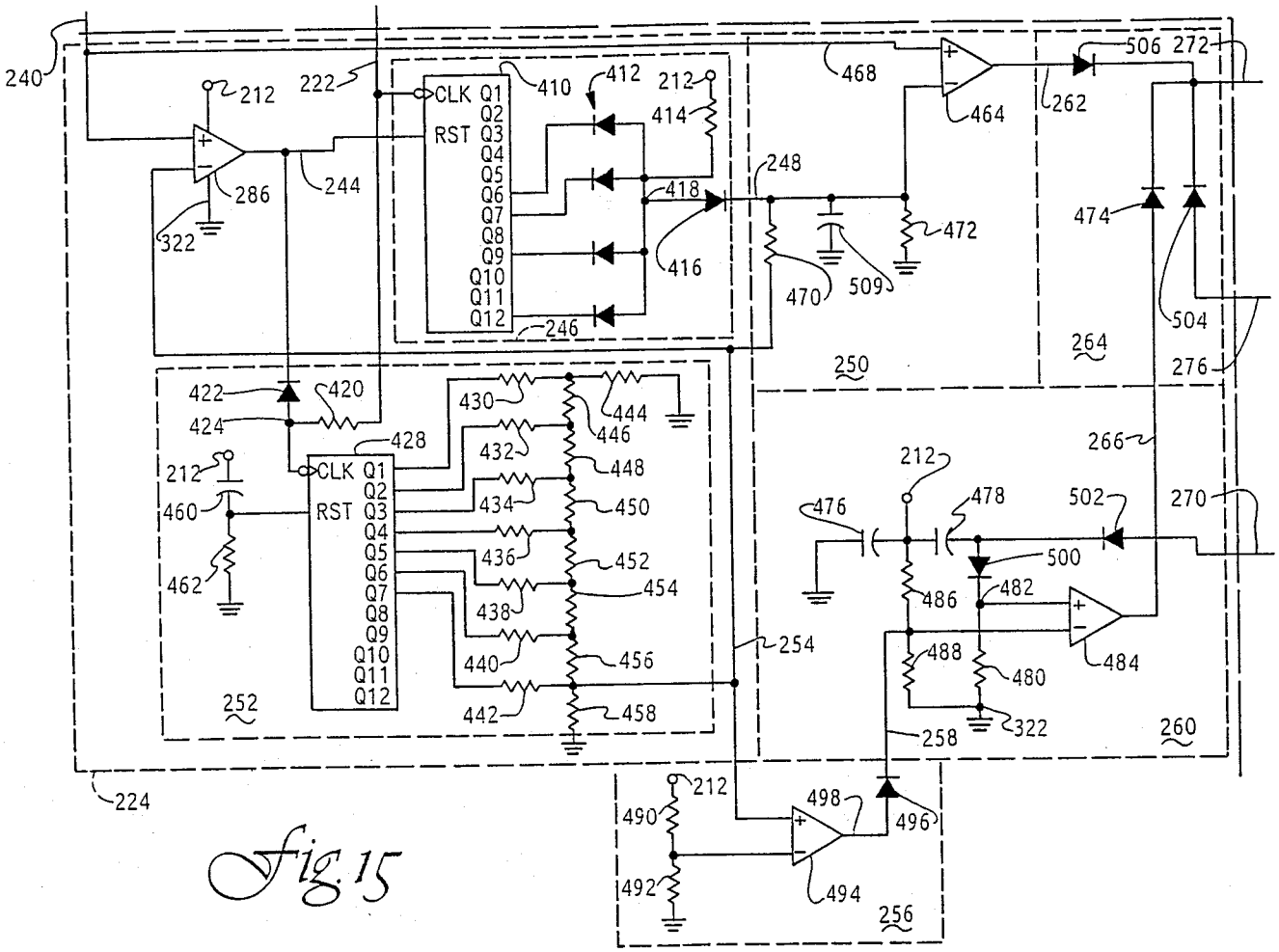
FIG. 15 is a detailed electrical schematic of the peak detector and post-peak timer, post-peak comparator, pre-pop timer override, pre-pop timer, and OR gate of FIG. 10.

Referring now also to FIG. 14, Power Supply 210 feeds a Clock 218 through line 220. The output of Clock 220 (which is a square wave proportional to the supply frequency) on line 222 is fed to a Peak Detector and Post-Peak Timer 224. A Sensor Circuit 226 has a microphone 316 to acoustically monitor popcorn popping in the oven. Circuit 226 provides a signal on line 228 representative of popping to an Amplifier and High-Pass Filter Block 230. Block 230 amplifies and filters low frequencies from the sensor signal 228 and provides a signal on line 232 to a Pop Detector 234. Pop Detector 234 may have a visual "popping" indicator 378 and provides a pulse train output on line 236 which is connected to an Averaging Circuit 238. Averaging Circuit 238 provides a POP RATE signal proportional to the time averaged rate of popping on line 240. Referring now also to FIGS. 11 and 15, the POP RATE signal 240 and CLK (clock) signal 222 are fed to a Peak Detector 242. A first output 244 of Peak Detector 242 is fed to Post-Peak Timer 246. An output 248 of Post-Peak Timer 246 is fed to a Post-Peak Comparator 250. Line 244 is also connected within Peak Detector 242 to a D/A (digital-to-analog) converter 252. The output of D/A 252 is connected on line 254 to Post-Peak Comparator 250 and a Pre-Pop Timer Override circuit 256. The signal on line 254 is the PEAK POP RATE.

Referring now more particularly to FIGS. 10 and 15, Pre-Pop Timer Override circuit 256 has an output on line 258 connected to a Pre-Pop Timer 260. Post-Peak comparator 250 has an output on line 262 connected to an OR gate 264. Pre-Pop Timer 260 has an output on line 266 connected to OR gate 264. Timer 260 is also connected to a Popping Done circuit 268 by line 270. The Popping Done circuit 268 has an audible annunciator 536 which sounds briefly when system 211 shuts down as popping is completed. OR gate 264 has an output on line 272 connected to a Start-Up and Shutdown Circuit 274. OR gate also has an input connected by line 276 to circuit 274.

Figure 13:
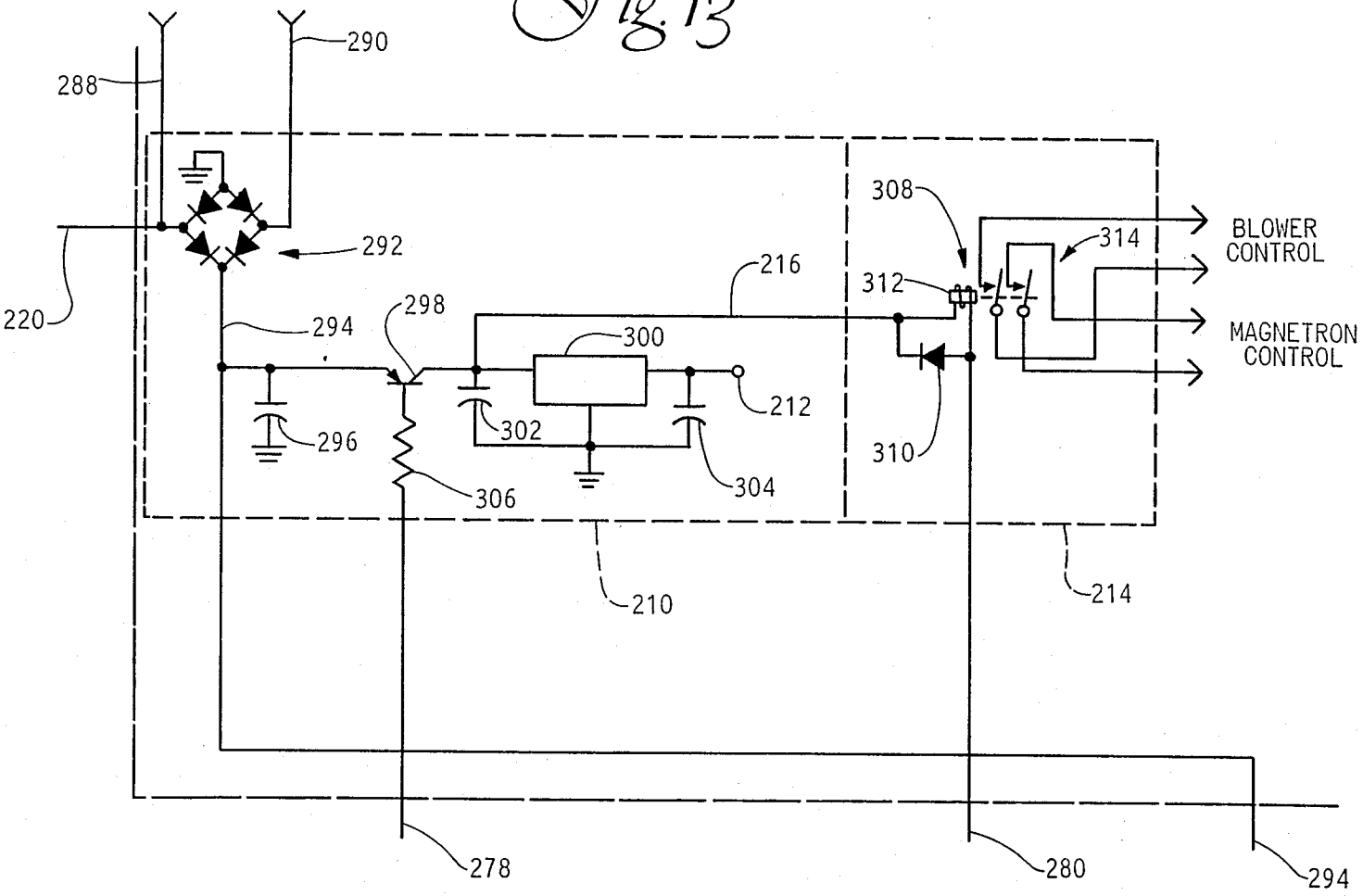
FIG. 13 is a detailed electrical schematic of the power supply and relay circuit of FIG. 10.
Figure 16:
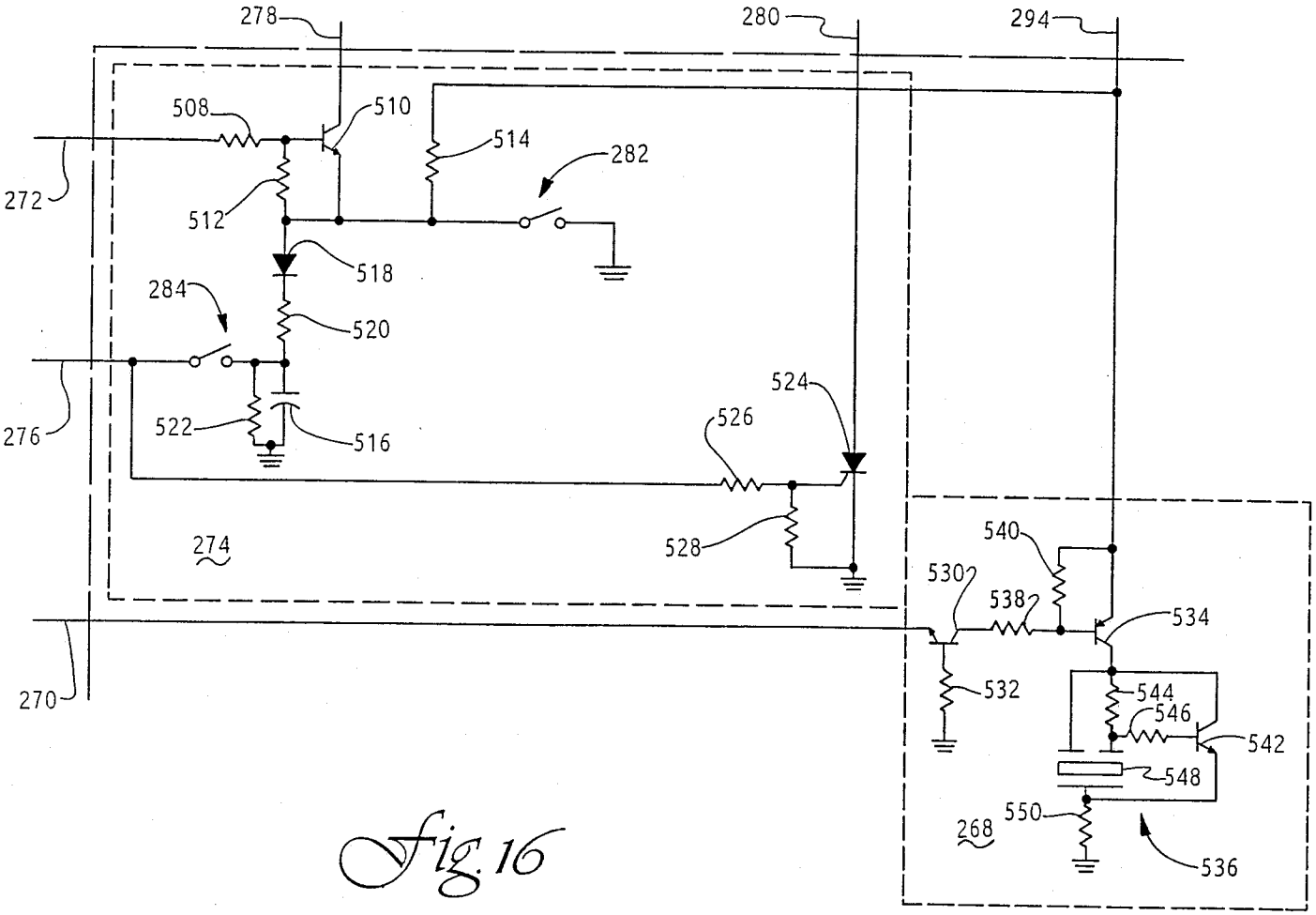
FIG. 16 is a detailed electrical schematic of the start-up circuit and popping done block of FIG. 10.

Referring now more particularly to FIGS. 16 and 13, circuit 274 has an output on line 278 connected to Power Supply 210. Circuit 274 also has a RELAY ENABLE output 280 connected to Relay Circuit 214.

The operation of Sensor 226, Amplifier and High-Pass Filter 230, Pop Detector 234, and Averaging Circuit 238 correspond in most respects to the operation of corresponding elements in the previously described embodiment, as shown in FIGS. 1-3. In this embodiment, microwave energy is applied to the popcorn, while Sensor circuit 226 acoustically monitors the popcorn and Averaging Circuit 238 provides a POP RATE signal 240 proportional to the rate of popping. Peak Detector 242 senses and retains the highest level of the POP RATE signal as a PEAK POP RATE signal 254.

It has been found that the most complete popping can be obtained for various loads of popcorn when application of microwave energy is terminated as the rate of popping falls to a predetermined ratio or fraction of the highest rate of popping for that specific load of popcorn. Specifically, for most presently available loads of popcorn prepackaged for microwave popping, the maximum amount of corn can be popped without scorching the corn already popped by turning off the oven when the POP RATE falls to 40% of the PEAK POP RATE.

System 211 terminates the application of microwave energy when the rate of popping falls to a predetermined ratio of the PEAK POP RATE 254 as determined by the Post-Peak Comparator 250. Pre-Pop Timer 260 ensures application of microwave energy for an initial predetermined time to enable enough energy to be applied to the popcorn for popping to commence.

It has been observed that certain loads of popcorn, even some packaged for popping in a microwave oven, require an excessive long time to "complete" popping. Towards the end of a popping cycle of such loads scorching has been observed before the completion of popping. To accommodate such loads, Post-Peak Timer 246 terminates the application of microwave energy after a terminal predetermined time measured from the time of sensing the peak popping rate when such predetermined time elapses prior to the post-peak popping rate falling to the predetermined ratio.

System Operation

The operation of the embodiment of FIG. 10 is as follows: to commence operation, popcorn is placed in the microwave oven and the door is closed, closing door switch 282 (see FIG. 16). If start switch 284 is closed within 30 seconds (nominal) after door switch 282 is closed, a signal on line 276 is sent to OR gate 264 commanding power supply 210 ON, thus providing regulated voltage 212 to the rest of the system, and powering relay circuit 214 through drive line 216. Circuit 274 also completes a power path for Relay Circuit 214 through the RELAY ENABLE line 280.

Upon presentation of a regulated voltage 212, Pre-Pop Timer 260 holds OR gate 264 ON through line 266 for a nominal 2 minutes. The operation of Pre-Pop Timer 260 results in the application of microwave energy to the popcorn for an initial predetermined time. If popping does not commence within that time, Pre-Pop Timer 260 releases line 266. Since no other inputs are then present at OR gate 264, output 272 commands Circuit 274 to shut off Power Supply 210 through line 278. This removes power from the Relay Circuit 214 through line 216, and shuts off the oven.

If popping commences prior to pre-pop timer releasing line 266, a POP RATE signal 240 and PEAK POP RATE signal 254 will be generated, holding OR gate 264 ON by the signal at line 262. Pre-Pop Timer 260 will be turned off by the Pre-Pop Timer Override 256 through line 258.

Sensor 226 will provide an output on line 228 representative of the popping of popcorn in the cavity 168 of the microwave oven 164. Amplifier and Filter 230, Pop Detector 234, and Averaging Circuit 238 will respectively process the signal received from Sensor 226 and provide a POP RATE signal 240 proportional to the time-weighted average of the rate of popping of the popcorn 22. The POP RATE signal 240 is provided to the Peak Detector and Post-Peak Timer 224 which tracks the POP RATE signal 240 and provides a PEAK POP RATE signal 254 corresponding to the highest popping rat detected for the individual load of popcorn then being popped.

It has been found that the best yield of popped corn for most presently available loads of unpopped corn prepackaged for microwave popping results when the application of microwave energy is terminated when the POP RATE falls to a predetermined ratio (typically 40%) of the peak popping rate. It has further been found that at least one commercially available load of popcorn prepackaged for microwave popping requires an excessively long time to pop. Such a slow-to-pop load will result in scorching of the popped kernels if microwave energy is applied until the POP RATE falls to 40% of the PEAK POP RATE. To avoid this result, the present control terminates popping at a predetermined time as measured from the time of detection of the PEAK POP RATE. It has been found that setting this time to 40 seconds will avoid interfering with more rapidly popped loads and will avoid scorching in such slow-to-pop loads (at the expense of a larger proportion of unpopped kernels). For most loads of commercially available popcorn presently sold for microwave popping, the 40% ratio is reached before 40 seconds elapse after the PEAK POP RATE occurs for that load. It is to be understood that it is within the scope of this invention to select other numerical values for the ratio and post-peak time. For example, as new compositions of loads of popcorn packaged for microwave popping become commercially available, either or both of these numerical values may be changed and still be within the spirit and scope of this invention. Thus, the operation of this embodiment terminates the application of microwave energy upon the earliest to occur of a terminal predetermined time measured from the time of sensing the PEAK POP RATE and a decrease in the Post-Peak POP RATE to the predetermined ratio. It is to be further understood that this invention is useful for popping "loose" popcorn in a suitable container in a microwave oven as well as for popping corn prepackaged for microwave popping.

Once the Post-Peak Comparator 250 determines that the POP RATE has fallen to 40% of the PEAK POP RATE, or that 40 seconds have elapsed since the peak, the signal on line 262 will drop, causing the output 272 of OR gate 264 to also drop, shutting off system 211 and activating the Popping Done circuit 268 and audible alarm 536 through line 270 to indicate that popping is done.

Clock 218 provides a 60 Hertz logic signal to the Post-Peak Timer 246 and the D/A converter 252 in the peak detector 242. In this embodiment, D/A 252 counts CLK (clock) pulses up when gated by the output of comparator 286 (see FIG. 11). As the POP RATE signal 240 increases above the last PEAK POP RATE held by the D/A converter 252, comparator 286 enables D/A converter 252 to count up clock pulses until output 254 is greater than pop rate 240 by 1 count of the D/A converter 252. Each time the POP RATE 240 falls below the PEAK POP RATE 254, Post-Peak Timer 246 is released and begins to run. Post-Peak Timer 246 will trip Post-Peak Comparator 250 if allowed to run for 40 seconds. Timer 246 is reset each time the POP RATE 240 exceeds the PEAK POP RATE 254 previously detected during popping. Output 248 remains OFF unless and until Post-Peak Timer 246 completely times out. Thus the output 248 will remain low during normal popping because Timer 246 is repeatedly reset by the signal on line 244 as the Peak Detector 242 senses increases in the POP RATE 240 and successively stores new values for PEAK POP RATE 254. As popping slows down, Detector 242 retains the highest PEAK POP RATE achieved while popping that load of popcorn; timer 246 continues counting; and Post-Peak Comparator 250 receives and compares the POP RATE 240 with the (highest) PEAK POP RATE 254 retained by peak hold circuit 242. Line 262 will be released by comparator 250 when the POP RATE falls to 40% of the PEAK POP RATE 254 or when timer 246 times out, whichever first occurs.

Detailed Circuit Description

Referring now to FIG. 13, Power Supply 210 receives AC power at a supply frequency (typically 60 Hertz) from a conventional transformer at lines 288, 290. A full wave rectifier 292 converts this power to an unregulated, filtered DC voltage of 16 volts (nominally) at 294. Capacitor 296 is preferably a 1000 uf capacitor for filtering. Transistor 298 is preferably a 2N4403 (as are other PNP transistors in this embodiment) and serves to switch power to the input of a voltage regulator 300 which is preferably a type 7812 manufactured by SGS—Thompson Components of 4414 Evan GL Circle #3, Huntsville, Ala. 35816. Regulator 300 supplies +Vcc preferably at +12 V to the remainder of system 211 through bus or terminals 212. A 0.1 uf capacitor 302 and a 0.1 uf capacitor 304 supply input and output filtering for voltage regulator 300. Transistor 298 has base drive applied through a 1.5K ohm resistor 306 from line 278.

Relay circuit 214 receives power from transistor 298 on line 216. The circuit for current to a relay 308 is completed by RELAY ENABLE line 280. A diode 310 is connected across the coil 312 of relay 308. Contacts 314 of relay 308 control power to the oven blower and magnetron (not shown).

Referring now to FIG. 14, sensor circuit 226 includes an acoustic sensor or microphone 316 which may be a model WM034BY microphone 316 manufactured by Panasonic. Microphone 316 may be physically mounted in oven 164 and acoustically coupled to the cavity 168 as shown in FIG. 9. A 5.6K resistor 318 supplies power to microphone 316 from the regulated voltage terminal or bus 212. A 3.3K ohm resistor 320 is connected across microphone 316 to circuit common 322. The output signal of sensor circuit 226 is coupled to a first stage 347 of circuit 230 by a 0.022 uf capacitor 324 and a 20K ohm resistor 326 to the inverting input 328 of one OP amp 330 of a LM324 type quad operational amplifier integrated circuit 330 as manufactured by National Semiconductor. The non-inverting input 332 of amplifier 330 is connected to a bias network having two 20K ohm resistors 334, 336 connected between +Vcc 212 and circuit common 322. The positive and negative power supply terminals 338, 340 of op amp 330 are connected respectively to +Vcc 212 and circuit common 322. It is to be understood that the other operational amplifiers and comparators in this system are preferably also type LM324, with each having appropriate power supply connections which have been omitted from the drawings for clarity. A 0.1 uf capacitor 342 is preferably located in close proximity to amplifier 230 to eliminate high-frequency noise. A 120K ohm resistor 344 is connected between the inverting input 328 and the output 346 of amplifier 330. A second stage 348 of amplifier and filter 230 includes three 20K resistors 350, 352, 354, a 120K feedback resistor 356, and a 0.022 uf capacitor 358 to provide op amp 359 with appropriate biasing, scaling and filtering such that the output on line 232 is an amplified and filtered signal representative of the sound of popcorn popping in the oven as sensed by microphone 316.

The signal on line 232 is supplied to the input of the Pop Detector 234, through a diode 360. With the exception of diode 310, all diodes in this embodiment are preferably type 1N4148. A 0.22 uf capacitor 366 is connected from the +Vcc power supply to the inverting input 367 of comparator 368. A 6.8M (meg) ohm resistor 370, a 2.2M ohm resistor 372, and a 1M ohm resistor 374 provide appropriate biasing and discharge paths for the input network of comparator 368. A 0.1 uf capacitor 376 provides a "pulse stretching" function in combination with diode 360 in a manner similar to capacitor 90 and diode 82 of FIG. 3. Capacitor 366 corresponds to the function of capacitor 92 in FIG. 3, however, it has been found preferable to connect it to the +Vcc to avoid undesirable perturbations during start-up of system 211. Diode 378 is a conventional light emitting diode or LED driven by transistor 380. Transistor 380 and all other NPN transistors in this embodiment are preferably type 2N4401. A 1K collector resistor 382 and a 47K base resistor 384 are connected to transistor 380. A 4.7K biasing resistor 386 is connected directly to LED 378. In operation, LED 378 is dimly lit while microwaves are being applied and momentarily flashes brightly when popping is detected. This "popping" indicator and its associated drive circuitry is not essential and may be omitted without detriment to the remainder of the system.

The output 236 of Pop Detector 234 is provided to a three-stage averaging filter 238. A 10K input resistor 388 and a 330 uf capacitor 390 form the first stage. The next succeeding stage has a 100K resistor 392 in combination with a 33 uf capacitor 394. The last stage is formed by a 1M resistor 396 combined with a 3.3 uf capacitor 398. It may be seen that each stage preferably has the same time constant, with 10:1 impedance ratios to "decouple" the stages from each other. A diode 400 provides a discharge path to "reset" capacitors 390, 394, 396 when popping is done and power is removed from terminal 212. It is to be understood that when power is shut off (by removing base drive from transistor 298) that +Vcc will go to 0 volts with a low impedance.

Clock circuit 218 is connected to the AC supply at 288 by line 220. Comparator 402 has a 100K input resistor 404 and a 1K divider resistor 406 and a 1K resistor 408 balance resistor to provide a 60 Hertz square wave clock signal on line 222.

Referring now to FIG. 15, clock signal 222 is utilized by Post-Peak Timer 246 and D/A 252. Timer 246 has a type 4040 CMOS binary counter/divider 410 (as manufactured, for example, by RCA) connected as a divide by 2400 divider by having four diodes 412 connected as an AND gate in combination with a 120K ohm resistor 414. Diode 416 provides isolation to the signal on line 248. In operation, once the reset input of counter 410 on line 244 is released (driven low) counter 410 will begin counting clock pulses on line 222. Once counter 410 counts up 2400 pulses, the output on line 248 will be driven high, indicating 40 seconds have elapsed since line 244 was released. If line 244 is driven high before 40 seconds elapse, timer 246 will have no effect on the signal on line 248, since diode 416 will block the low voltage appearing at node 418.

Clock signal 222 is also supplied to D/A converter 252 through a 100K resistor 420 when the signal on line 244 is high. When line 244 is driven low, a diode 422 will hold node 424 low, blocking clock signal 222 from reaching a second 4040 type counter 428. When counter 428 is permitted to count clock signal 222, it will provide a "staircase" type ramp signal increasing in value from zero volts up to a maximum of 3 volts on line 254. The D/A function is generated by an "R2R" ladder network having 20K resistors 430–444 and 10K resistors 446–456. A 3.3K ohm scaling resistor 458 is used to adjust the full scale value of the PEAK POP RATE signal on line 254. Comparator 286 and D/A converter 252 make up peak detect and hold circuit 242 (see FIG. 11). A 0.01 uf capacitor 460 and a 100K resistor 462 initialize counter 428 to zero upon start-up, thus setting the PEAK POP RATE to zero each time the system is started up.

In operation, peak detector and hold circuit senses the popping rate on line 240 and, upon start-up, line 244 is driven high, enabling counter 428 to commence counting. Once the PEAK POP RATE 254 exceeds the POP RATE on line 240, comparator 286 pulls line 244 low, thus blocking further counting of counter 428. As popping increases, with a corresponding increase in the voltage of the signal on line 240, counter 428 will be enabled through diode 422 to count the clock pulses through node 424, thus increasing the level of the signal on line 254. It is to be understood that the signal on line 254 can only count up, and will "track" increases in the signal on line 240 because of the action of comparator 286.

As the popping cycle continues, popping (and the POP RATE signal on line 240) will gradually decrease. The signal on line 254 will remain, however, at the highest average popping rate sensed. As soon as popping decreases, Post-Peak Timer 246 will be enabled because line 244 has released the reset input of counter 410. Comparator 464 monitors the popping rate on line 240 at its non-inverting input 468 and compares it to the predetermined ratio of the peak popping rate set by resistors 470 and 472. Preferably, it has been found to use a 150K ohm value for resistor 470 and a 100K ohm value for resistor 472 for a 40% ratio. The output of the Post-Peak Comparator circuit 250 is held high by comparator 464 until the POP RATE 240 falls below 40% of the PEAK POP RATE held on line 254. Once the signal on line 240 falls below the predetermined ratio set by resistors 470, 472 of the signal on line 254, the signal on line 262 is driven low, and the system is shut down.

It is to be understood that during the initial stages of popping, comparator 464 may repeatedly switch on and off. To avoid premature shut down of the system, a Pre-Pop Timer 260 holds the system ON through diode 474 in OR gate 264. Pre-Pop Timer circuit 260 includes a 0.1 uf filter capacitor 476, a 100 uf timing capacitor 478, and a 1M timing resistor 480. Pre-Pop Timer commences operation when start switch 284 is closed, causing terminal 212 to go to +Vcc. Capacitor 478 begins to charge, causing the node 482 to follow an exponential voltage decay from +Vcc to 0 volts. Comparator 484, has a trip point set by a 300K resistor 486 and a 150K resistor 488. Comparator 484 will hold output 266 high for approximately 2 minutes in the absence of any popping in the microwave oven. This will hold the system on through diode 474 in OR gate 264. In the absence of popping, timer 260 will time out and the system will shut down.

If popping commences within 2 minutes of the start switch closure, the Pre-Pop Timer Override circuit 256 senses the PEAK POP RATE 254 and compares it to a pre-set value set by a 220K ohm resistor 490 and a 10K resistor 492. Once the PEAK POP RATE 254 exceeds this threshold, comparator 494 drives line 258 high, overriding and shutting down the Pre-Pop Timer 260, causing line 266 to be driven low. This transfers control to the Post-Peak Comparator Circuit 250, which keeps the system ON through line 262 (see FIG. 10). Diode 496 blocks the output 498 of comparator 494 while it is negative, to avoid interference with the timing circuit of Pre-Pop Timer 260 while output 498 is negative. Diode 500 prevents latch-up of a SCR parasitic which might otherwise occur in comparator 484 during the shut down sequence, and diode 502 decouples timing capacitor 478 from line 270, but permits line 270 to be pulled down when node 212 goes to zero upon shut down. Diode 504, 474, and 506 form OR gate 264.

Referring now to FIG. 16, Start-up and Shut Down Circuit 274 receives the output 272 from OR gate 264 and holds line 278 on (low) as long as line 272 is high. When line 272 drops low, line 278 is released, removing base drive from transistor 298, causing terminal 212 to go to zero volts, and turning off relay 308 through the removal of power on line 216. A 10K base resistor 508 limits base current to a transistor 510. A 1.2K resistor 512 keeps transistor 510 cut off in the absence of base current through resistor 508. Referring now also to FIG. 15, a 0.1 uf capacitor 509 connected to line 248 ensures complete shutdown of the system 211 by effectively disabling a negative feedback path which may otherwise interfere with proper system shutdown. A 4.7K ohm resistor 514 charges a 100 uf capacitor 51 through diode 518 and a 4.7K ohm resistor 520 while door switch 282 is open. Once the oven door is closed, switch 282 is closed, and capacitor 516 will begin to discharge through a 300K resistor 522. If start switch 284 is closed within about 30 seconds of the closing of door switch 282, there will be sufficient charge on capacitor 516 to start up the system by pulling line 276 high. Pulling line 276 high will gate SCR 524 ON through a 10K resistor 526. SCR 524 (which is preferably a type EC103B manufactured by Teccor Electronics, Inc. of 1801 Hurd Drive, Irvine Tex. 75038) has a 2.2K ohm gate ballast resistor 528 and completes the circuit through line 280 to provide the RELAY ENABLE function for the Relay Circuit 214. It is to be understood that switch 284 is preferably a momentary contact, normally open type switch.

Upon shut down, line 270 is connected to a low impedance temporarily at a negative voltage between one third Vcc and Vcc because of the charge on capacitor 478, thus momentarily turning on transistor 530 which has a base resistor 532 of 100K. Turning on transistor 530 causes a transistor 534 to turn on, applying power to a piezioelectric transistor oscillator-crystal annunciator circuit 536. A 20K resistor 538 connects the collector of transistor 530 to the base of transistor 534. A 2.2K resistor 540 is connected between the base and emitter of transistor 534 to keep transistor 534 off in the absence of base drive. A transistor 542 is connected to a 47K ohm resistor 544 and a 30K ohm resistor 546. Piezioelectric element 548 is preferably a model SEC-3109 FP manufactured by Star Micronics, Inc. of 500 Park Boulevard, Suite 645, Itasca, Ill., 60743. A 1.5K ohm resistor 550 completes the circuit path for oscillator-annunciator 536.

Figure 17:
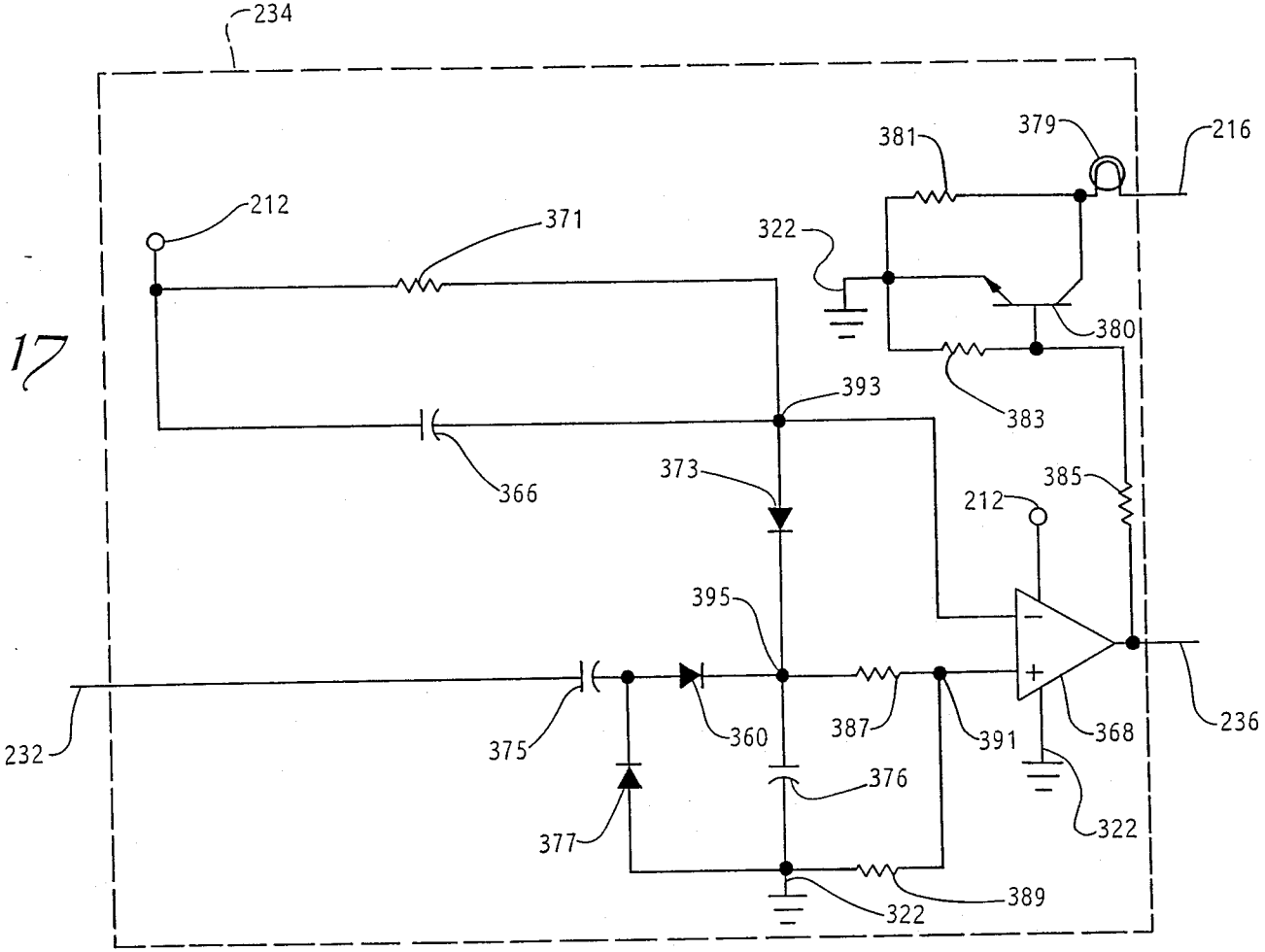
FIG. 17 is a detailed electrical schematic of an alternative pop detector useful in the system of FIG. 10.

Referring now to FIG. 17, a still further embodiment for the pop detector 234 of FIG. 10 may be seen. In this embodiment, pop detector 234 receives an input 232 from filter circuit 230, and provides a pop signal output 236 to averaging or integrating circuit 238. In addition, alternative indicator 379 receives power from the unregulated, switched line 216. This embodiment also receives regulated power at terminal 212 and is referenced to system common or ground 322. The signal on line 232 is decoupled by a 0.1 uf capacitor 375 which, together with diodes 360 and 377 and the 0.1 uf capacitor 376, form a type of voltage doubler circuit. A diode 373 replaces resistor 372 of the previous embodiment. In this embodiment, capacitor 366 again has a value of 0.22 uf, while resistor 370 is replaced by a 2.2 meg ohm resistor 371, connected to +Vcc. A 33K resistor 387 and a 100K resistor 389 have been added to this circuit at the non-inverting input 391 of op amp 368 connected as a comparator. Comparator 368 has output 236 connected through a 6.8K resistor 385 to transistor 380, while a 2.2K ohm resistor 383 is connected between resistor 385 and circuit common 322. In this embodiment, indicator 379 is preferably a T-1¾ type incandescent lamp, such as a model ML7382 available from Micro Lamps Inc., 1530 Hubbard Ave, Batavia, Ill. 60510, and is connected through a 47 ohm resistor 381 to ground 322.

In operation, the signal on line 232 will swing in a range between approximately zero volts and Vcc less some offset, with a quiescent value nominally at the mid point of that range. Capacitor 375 provides a DC blocking function, while diode 377 "restores" a DC level (of approximately zero volts) at node 395 because of diode 360. Neglecting diode drops, capacitor 376 will be at substantially the peak value of the AC component of the signal on line 232. The signal at node 393 corresponds to a floating reference level which is no more than one diode drop above node 395 because of diode 373. The signal at node 395 is a pop impulse similar to pulse 156 (see FIG. 5). The signal at node 391 is a fixed percentage of the signal at node 395, set by resistors 387 and 389. For the values specified, the signal at node 391 is 75% of that at 395.

The circuit of FIG. 17 rejects response signals on line 232 as follows: for an aperiodic signal having a rapid rise time, or fast rate of attack, the voltage at node 395 will momentarily rise, while the voltage at node 393 will not be able to follow and comparator 368 will output a pulse on line 236 in a fashion similar to pulse 162 (FIG. 5) except inverted. For a slowly changing signal on line 232, node 393 will "track" one diode drop above node 395 and comparator 368 will not provide any output pulse. For a rapidly changing but periodic signal on line 232, capacitor 376 will "hold" the voltage at node 395 high and the voltage at node 393 will again rise to one diode drop above node 395, thus causing comparator 368 to remain quiescent in the steady state after a possible initial "settling time." Circuit 234 of FIG. 17 thus discriminates popping information from both low and high frequency phenomena on line 232.

The circuit of FIG. 17 also provides the effect of a DC offset for low signal levels on line 232 (due to diode 373) which becomes less significant (a smaller percentage) at higher signal levels on line 232. The circuit of FIG. 17 has been found to be especially useful when Vcc is selected to be 8 volts, which may be accomplished by using a model 7808 regulator 300 as manufactured by SGS—Thompson Components.

If it is desired to increase the sensitivity of the Pop Detector 234 during periods of intense popping, resistor 371 can be connected between node 393 and a voltage somewhat less than Vcc. This will have the effect of reducing the upper limit of "floating reference" 393, thus making Pop Detector 234 more sensitive than it otherwise would be.

When Vcc is selected to be +8 volts DC, the part values for certain resistors and capacitors are desirably adjusted. The following table lists part values for the referenced elements which are desirably changed for operation at Vcc=+8 volts DC.

TABLE 1

| Element | Part Value |
|---|---|
| 318 | 3.9K |
| 320 | 5.1K |
| 324 | 0.022 uf |
| 344 | 160K |
| 350 | 10K |
| 352 | 6.8K |
| 356 | 160K |
| 358 | 0.022 uf |
| 388 | 15K |
| 390 | 220 uf |
| 392 | 33K |
| 394 | 100 uf |
| 396 | 68K |
| 398 | 47 uf |

TABLE 1-continued

| Element | Part Value |
|---|---|
| 414 | 300K |
| 458 | 2.2K |
| 490 | 150K |
| 492 | 10K |
| 488 | 100K |
| 508 | 4.7K |

Figure 18:
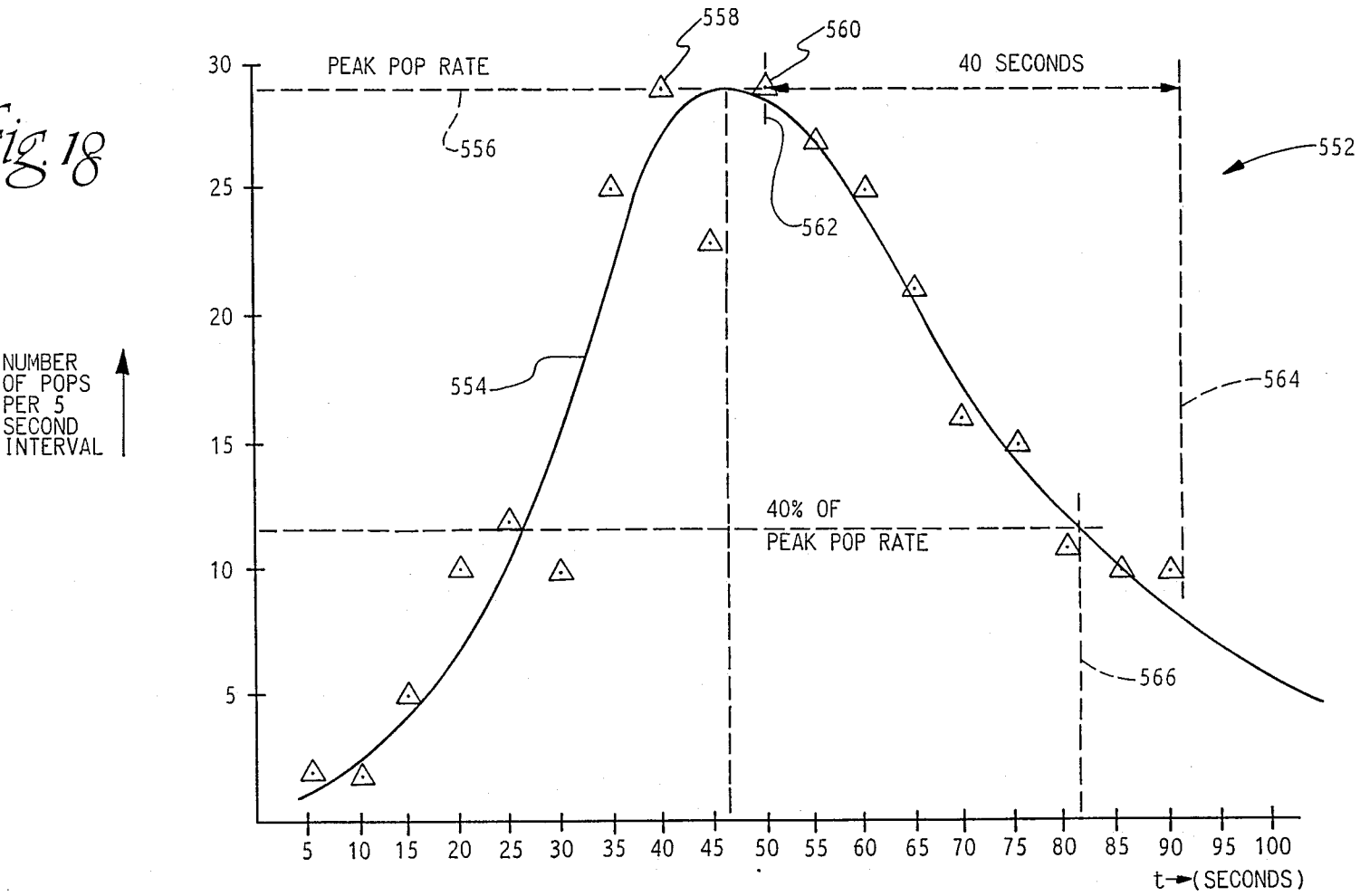
FIG. 18 is a simplified graphical representation of a popping cycle illustrating certain aspects of the present invention.

Referring now more particularly to FIG. 18, certain theoretical and practical aspects of the present invention may be observed. FIG. 18 shows a plot of the number of pops per each incremental five second interval plotted against time for a particular load of popcorn prepackaged for microwave popping. Plot 552 is believed to correspond to a normal distribution curve 554. It is to be understood that in the controller of this invention, individual pops are sensed and averaged, while in this plot 552, individual pops are aggregated in five second intervals. This results in an artificial "bunching" of data at each five second time interval. Nevertheless, it may be seen that the peak pop rate 556 is initially detected at data point 558 and again at data point 560. If the peak pop rate 556 were detected for the last time at the time of data point 560, the post-peak timer 246 would commence timing at the time 562 of data point 560. If allowed to complete its timing, timer 246 would terminate popping 40 seconds later, at time 564 (to prevent scorching of the already popped popcorn).

The test data for this load of popcorn shows, however, that the rate of popping (indicated by curve 554) fell to 40 percent of the peak pop rate less than 40 seconds after the peak pop rate was (last) detected. As the (average) popping rate falls below 40 percent of the peak pop rate, the system is shut down at time 566. Table 2 includes the incremental pops and cummulative total pops for this load of popcorn.

TABLE 2

| Time (Seconds) | Incremental Pops | Cumulative Total |
|---|---|---|
| 5 | 2 | 2 |
| 10 | 2 | 4 |
| 15 | 5 | 9 |
| 20 | 10 | 19 |
| 25 | 12 | 31 |
| 30 | 10 | 41 |
| 35 | 25 | 66 |
| 40 | 29 | 95 |
| 45 | 23 | 118 |
| 50 | 29 | 147 |
| 55 | 27 | 174 |
| 60 | 25 | 199 |
| 65 | 21 | 220 |
| 70 | 16 | 236 |
| 75 | 15 | 251 |
| 80 | 11 | 262 |
| 85 | 10 | 272 |
| 90 | 10 | 282 |

After 50 seconds a cumulative total of 147 pops have been detected. If this is considered to be 50% of the area under curve 554, 90% of the area under the curve (the integral of pops detected) is reached after 80 seconds ($294 \times 0.9 = 265$). Thus by sensing when the popping rate fails to 40% of the peak pop rate, approximately 90% of the popcorn in a particular load can be popped, without scorching the corn already popped in that load. It may thus be seen that this invention pops popcorn in a microwave oven by applying microwave energy to a load of popcorn in the cooking cavity of a microwave oven while acoustically monitoring that popcorn and providing a signal representative thereof and terminating the application of microwave energy when the signal representative of popping indicates a predetermined percentage of the load of popcorn has been popped.

The invention is not to be taken as limited to all of the details thereof as modifications and variations thereof may be made without departing from the spirit or scope of the invention.

What is claimed is:

1. A method of popping popcorn in a microwave oven comprising:

(a) applying microwave energy to the popcorn;

(b) acoustically monitoring the popcorn and providing a pop rate signal proportional to the rate of popping;

(c) sensing and retaining the highest level of the pop rate signal as a peak pop rate; and (d) terminating the application of microwave energy when the rate of popping falls to a predetermined ratio of the peak pop rate.

2. The method of claim 1 wherein the monitoring of the popcorn is continuous.

3. The method of claim 1 wherein the monitoring of the popcorn is discontinuous.

4. The method of claim 3 wherein the monitoring of the popcorn is periodic.

5. The method of claim 1 wherein step (a) further comprises applying the microwave energy for an initial predetermined time.

6. The method of claim 1 wherein step (d) further comprises terminating the application of microwave energy upon the earliest to occur of a terminal predetermined time measured from the time of sensing the peak pop rate and a decrease in the post-peak pop rate to the predetermined ratio.

7. Apparatus for popping popcorn in a microwave oven comprising:

(a) sensing means for sensing popcorn popping in a microwave oven cavity and for providing an output signal representative thereof;

(b) rate means having:

(i) an input connected to the sensing means for receiving the output signal from the sensing means; and (ii) an output for providing a rate signal proportional to a time-weighted average of the rate of popping;

(c) peak detecting means connected to the output of the rate means for detecting the peak popping rate; and (d) ratio means connected to the peak detecting means for terminating application of microwave energy to the popcorn when the rate signal falls to a predetermined ratio of the peak popping rate.

8. The apparatus of claim 7 wherein the sensing means includes an acoustic sensor.

9. The apparatus of claim 8 wherein the acoustic sensor comprises a microphone.

10. A method of popping popcorn in a microwave oven comprising the steps of:

(a) applying microwave energy to a load of popcorn in a cooking cavity of the microwave oven;

(b) acoustically monitoring the popcorn and providing a signal representative of the popcorn popping rate;

(c) terminating the application of microwave energy when the signal representative of popping rate indicates a predetermined percentage of the load of popcorn has been popped.

11. The method of claim 10 wherein the predetermined percentage is in the range of 85 to 95 percent.

12. The method of claim 10 wherein the predetermined percentage is 90 percent.

13. The method of claim 10 wherein the rate of popping is sensed and the application of microwave energy is terminated upon the expiration of a predetermined time measured from the highest rate of popping sensed.

14. The method of claim 13 wherein the application of microwave energy is terminated upon reaching the first to occur of the predetermined percentage and the expiration of the predetermined time.

15. The method of claim 14 wherein the predetermined time is in the range of 30 to 50 seconds.

16. The method of claim 15 wherein the predetermined time is 40 seconds.

17. The method of claim 13 wherein the predetermined ratio is in the range of 85 to 95 percent.

18. The method of claim 17 wherein the predetermined ratio is 90 percent.

19. Apparatus for popping popcorn in a microwave oven comprising:

(a) first means for applying microwave energy to a load of popcorn;

(b) second means for sensing popping rate of the load of popcorn and for providing an output signal representative thereof;

(c) third means for terminating application of microwave energy to the load of popcorn when the output signal indicates that a predetermined ratio of the load of popcorn has been popped.

20. The apparatus of claim 19 wherein the predetermined ratio is in the range of 85 to 95 percent.

21. The apparatus of claim 20 wherein the predetermined ratio is 90 percent.

22. The apparatus of claim 19 wherein the third means further comprises (d) means for retaining the highest value of the output signal and for terminating application of microwave energy to the load of popcorn a predetermined time after the highest value of the output signal is detected.

23. The apparatus of claim 22 wherein the application of microwave energy is terminated upon the third means reaching the first to occur of the predetermined ratio and the predetermined time.

24. The apparatus of claim 23 wherein the predetermined ratio is in the range of 85 to 95 percent.

25. The apparatus of claim 24 wherein the predetermined ratio is 90 percent.

26. The apparatus of claim 22 wherein the predetermined time is in the range of 30 to 50 seconds.

27. The apparatus of claim 26 wherein the predetermined time is 40 seconds.

* * * * *